US007677402B2

(12) United States Patent
Mensah-Ouvor et al.

(10) Patent No.: US 7,677,402 B2
(45) Date of Patent: Mar. 16, 2010

(54) CLOSING DEVICE WITH INTEGRATED ROTARY CLOSURE FOR FEEDING BOTTLE AND BOTTLE

(75) Inventors: Messanvi Vincent Mensah-Ouvor, Saint Cheron (FR); Ayawovi Lucie Nous-Soukpoe-Mensan, Saint Cheron (FR)

(73) Assignee: Ayawovi Lucie Nous-Soukpoe-Mensan, Saint Cheron (FR)

( * ) Notice: Subject to any disclaimer, the term of this patent is extended or adjusted under 35 U.S.C. 154(b) by 337 days.

(21) Appl. No.: 11/908,626

(22) PCT Filed: Mar. 17, 2006

(86) PCT No.: PCT/FR2006/000594

§ 371 (c)(1),
(2), (4) Date: Sep. 14, 2007

(87) PCT Pub. No.: WO2006/097640

PCT Pub. Date: Sep. 21, 2006

(65) Prior Publication Data

US 2008/0210656 A1 Sep. 4, 2008

(30) Foreign Application Priority Data

Mar. 17, 2005 (FR) ..... 05 02641

(51) Int. Cl.
*A61J 9/00* (2006.01)

(52) U.S. Cl. ..... 215/11.4; 215/11.1; 215/11.6; 220/253; 220/256.1; 220/254.1; 220/254.4; 220/211

(58) Field of Classification Search ..... 215/11.1, 215/11.4, 11.6, 387; 220/211, 253, 254.1, 220/254.4, 256.1, 59.3, 259.4, 714, 719
See application file for complete search history.

(56) References Cited

U.S. PATENT DOCUMENTS

| | | | | |
|---|---|---|---|---|
| 3,211,315 | A * | 10/1965 | Griesinger | 215/11.1 |
| 4,856,995 | A * | 8/1989 | Wagner | 433/215 |
| 5,353,964 | A * | 10/1994 | Liu et al. | 222/134 |
| 6,550,640 | B2 * | 4/2003 | Smith | 222/1 |
| 2006/0213857 | A1 * | 9/2006 | Chen et al. | 215/11.1 |

* cited by examiner

*Primary Examiner*—Anthony Stashick
*Assistant Examiner*—Madison L Wright
(74) *Attorney, Agent, or Firm*—Laurence A. Greenberg; Werner H. Stemer; Ralph E. Locher

(57) ABSTRACT

The invention concerns a device for hermetically and safely closing a feeding bottle to avoid any leakage of the liquid. Said closing device comprises: a rotary closure consisting of an inner ferrule and of an outer ferrule each having an offset opening respectively and, the inner ferrule being lodged in the outer ferrule. An internal thread of the inner ferrule enables the rotary closure to be fixed to the threaded neck of the feeding bottle. A nipple, inserted in a retaining ring comprising an internal thread, is fixed to the threaded neck of the rotary closure. A cap is provided, which enables the nipple to be protected. The inventive device is particularly designed for hermetically closing the feeding bottle.

5 Claims, 4 Drawing Sheets

CLOSING DEVICE WITH INTEGRATED ROTARY CLOSURE FOR FEEDING BOTTLE AND BOTTLE

BACKGROUND OF THE INVENTION

Field of the Invention

While the feeding bottle, in its traditional form, has proved to be perfectly usable, there are nonetheless some remaining technical difficulties that mothers face on a daily basis. One of these difficulties that mothers face is that of being able always to keep the feeding bottle upright in any form of bag for example, because in any other position, since the neck of the feeding bottle is open, the liquid would easily flow to the tip of the teat and ultimately escape from the orifice (1) therein. Even if there is a cap (2) to protect the teat (3), the problem of liquid flowing out from the orifice (1) is not solved by the presence of this cap.

SUMMARY OF THE INVENTION

The object of this invention is to avoid this disadvantage by allowing the feeding bottle to be sealed more reliably using a sealing device.

The term feeding bottle (13) will be used here for any container chiefly comprising a container and a teat, which may contain a liquid, and which is intended for infants (aged 0 to 2 years for example). This liquid may be milk, water or any other drink (fruit juice, yoghurt, etc).

The present invention therefore relates to a sealing device with built-in rotary closure, for a feeding bottle (13). The attached drawings illustrate the invention:

DESCRIPTION OF THE INVENTION

Figure 1:
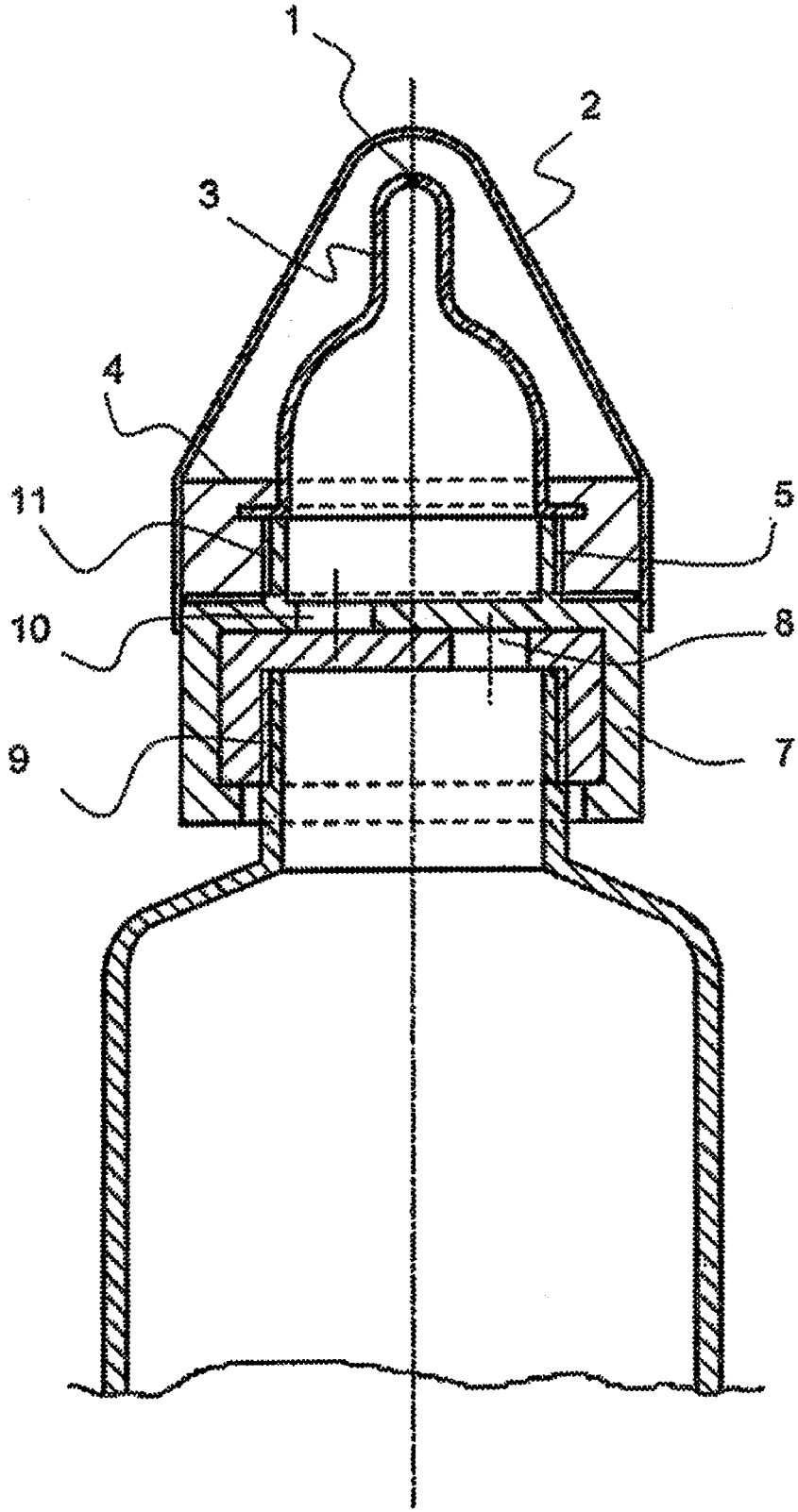
FIG. 1 depicts the complete sealing device with built-in rotary closure, for a feeding bottle.
Figure 2:
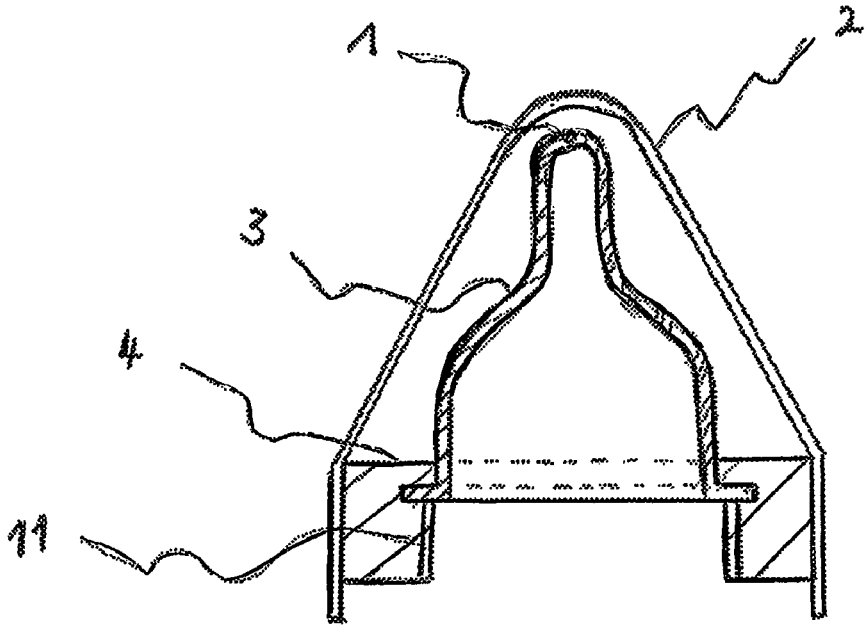
FIG. 2 depicts the built-in rotary closure detached from the teat (3) retaining ring (4)
Figure 2:
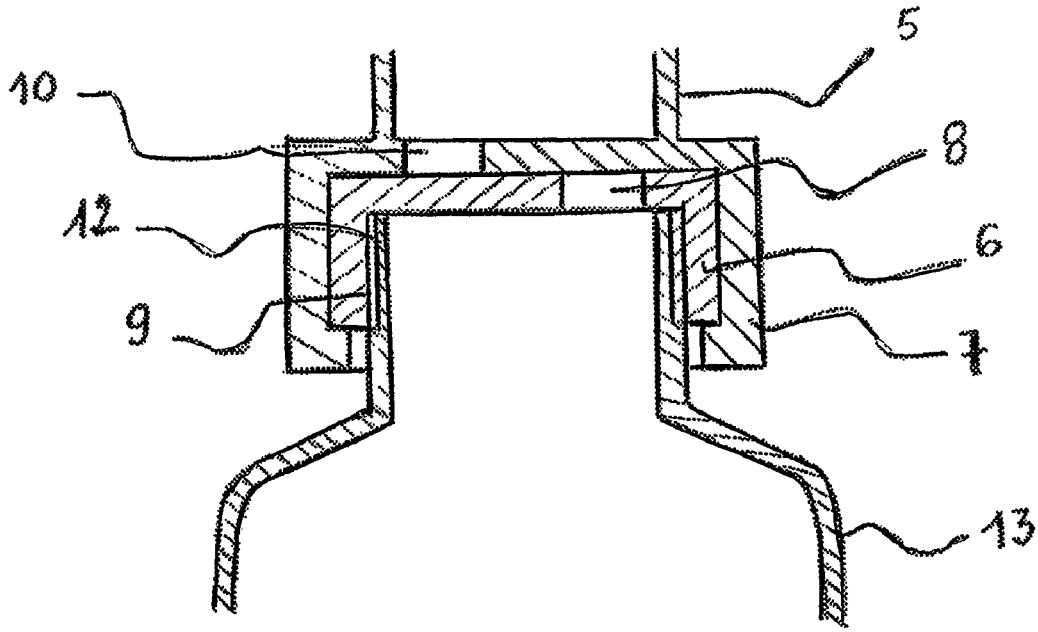

The sealing device with built-in rotary closure according to the invention consists of: two ferrules, an internal one (6) and an external one (7), all made of plastic, and acting as a rotary closure. Said rotary closure is inserted between a teat (3) introduced into a retaining ring (4) and the screw thread (12) of the feeding bottle (13).

The retaining ring (4) has an internal screw thread (11) that allows it to be screwed directly onto the external screw thread (5) of the rotary closure.

The internal ferrule (6), via its internal screw thread (9), is screwed directly onto the threaded neck (12) of the feeding bottle (13).

The external ferrule (7) with its external screw thread (5) accepts, via the top, the teat (3) retaining ring (4).

Figure 3:
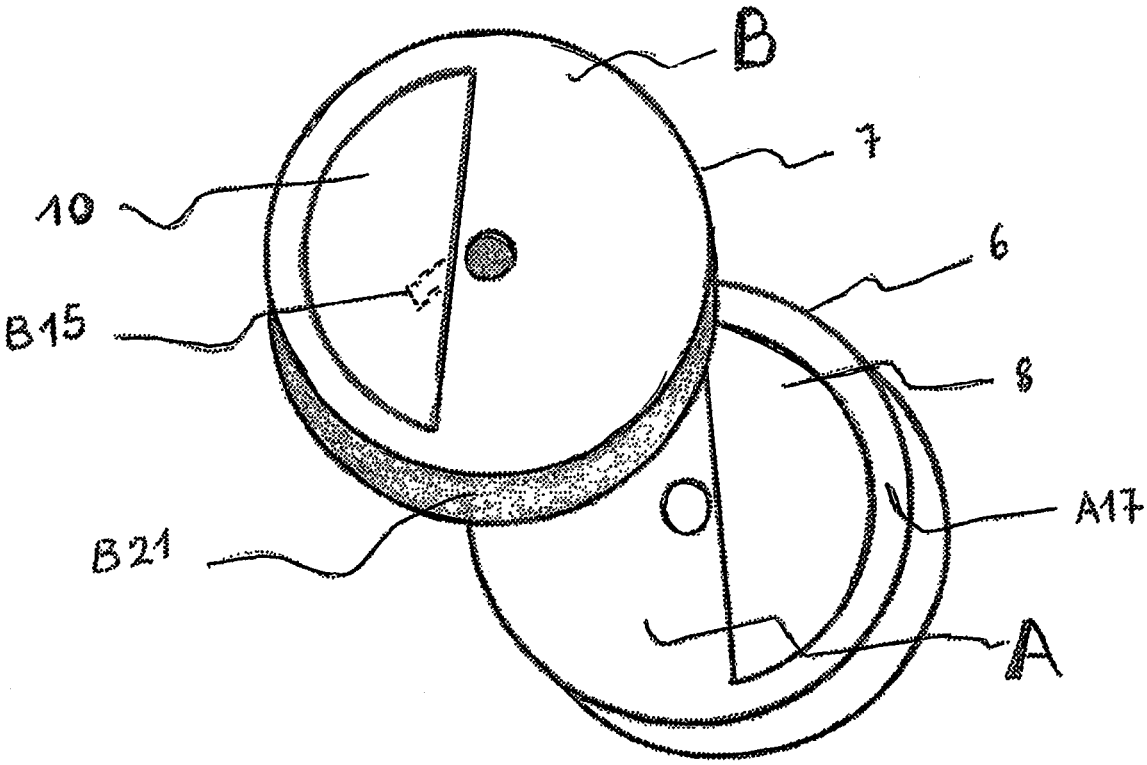
FIG. 3 shows the disks A and B of the internal (6) and external (7) ferrules of the built-in rotary closure.
Figure 3:
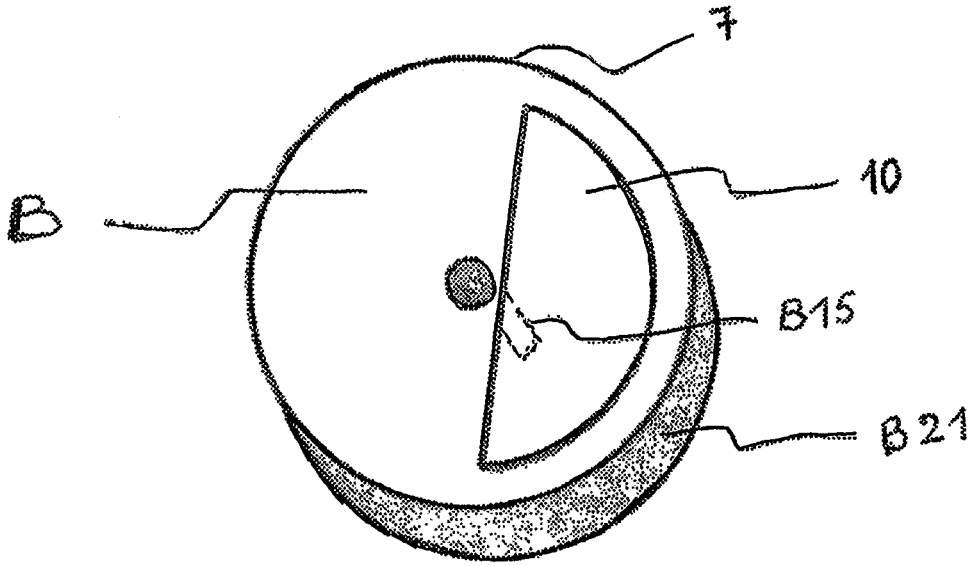

These two ferrules, the internal one (6) and the external one (7), which constitute the rotary closure, each have a disk—A in the case of the internal one and B in the case of the external one—which are in contact with one another, being connected by an internal pivot (B15 (FIG. 3)) mounted on the inside, at the center of the external ferrule (7).

Since the internal ferrule (6) is inset within the external ferrule (7), the flange of the pivot that is not visible in the figures here, holds these ferrules together, the disk A of the internal ferrule (6) being in contact with the disk B of the external ferrule (7). A perforation (A17 (FIG. 3)) at the center of the disk A of the internal ferrule (6) allows the internal ferrule (6) to be inset within the external ferrule (7).

The rotary closure mechanism is afforded mainly by the internal and external ferrules, the disks A and B of which are superposed and each respectively has an off-centered opening (8) and (10) occupying more than ¼ of its surface area. The external ferrule (7) has an outside diameter greater than that of the other elements of the device and has external ribs (B21 (FIG. 3)) to allow it to be turned.

In the direction of sealing, in the rotational movement, there is some latitude for pivoting. The disk (B) of the external ferrule (7) is orientated in such a way that the openings (8) and (10) of the first (A) and second (B) disks respectively are offset, thus completely closing off the feeding bottle (13). A sealing gasket may be provided between the internal (6) and external (7) ferrules to make the feeding bottle (13) seal more reliably.

In the direction of opening, in the rotational movement, the disk (B) of the external ferrule (7) is orientated in such a way that the openings (8) and (10) of the disks (A) and (B) respectively return to a position in which they face one another, allowing a liquid contained in the feeding bottle (13) to flow. A cap (2) is provided, for protecting the teat (3).

The invention can also be put to use on disposable feeding bottles or bottles.

Figure 4:
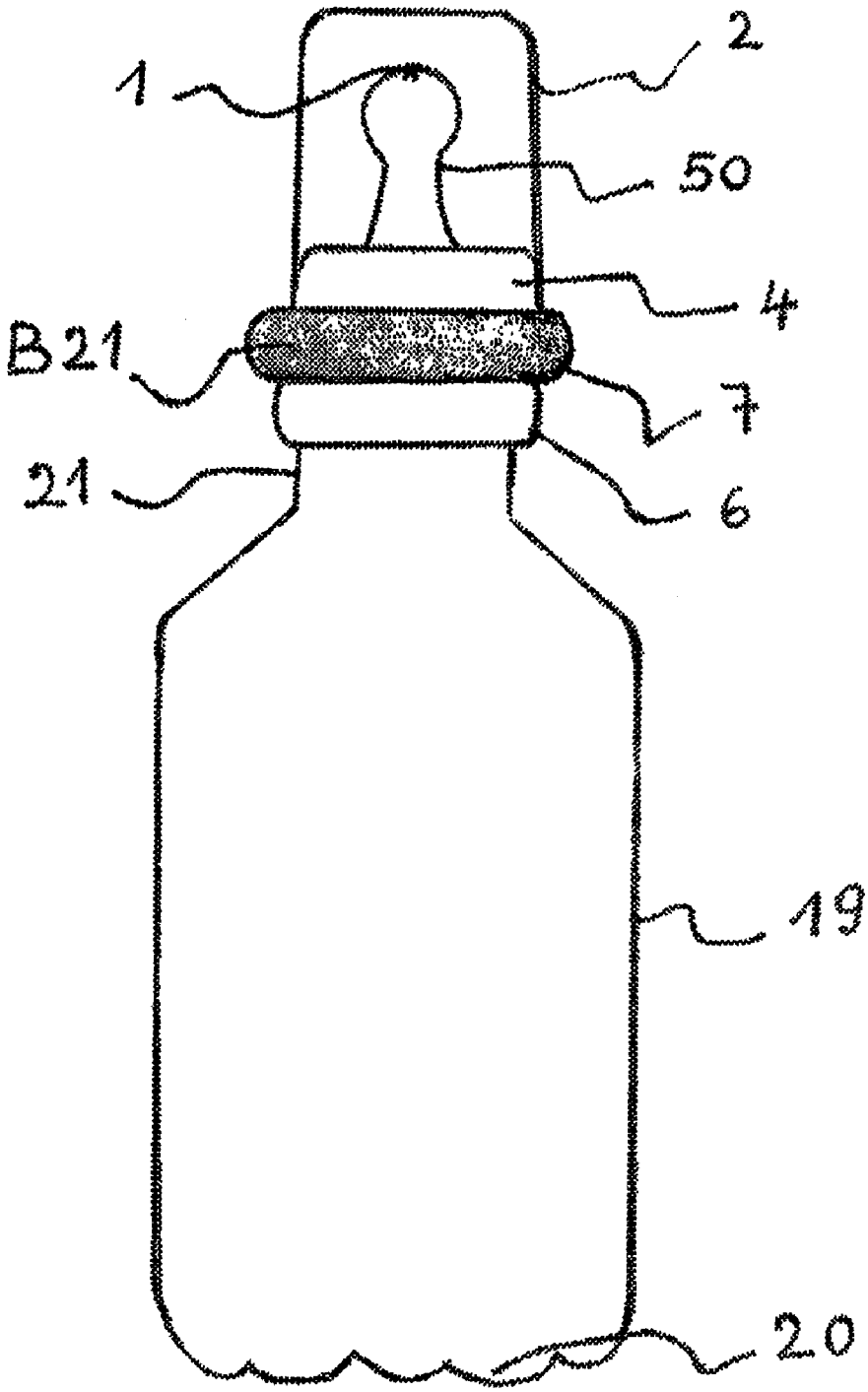

FIG. 4 illustrates the profile of a plastic bottle fitted with the sealing device with built-in rotary closure.

The sealing device of the invention can then be fixed to the bottle permanently by crimping. The bottle comprises a container (19) with a closed bottom (20) and an unthreaded neck (21) onto which the sealing device is crimped once the bottle has been filled with the liquid. The container (19) and the sealing device become one integral part.

The sealing device comprises not a teat but a drinking spout (50) fixed on top of the retaining ring (4). All the elements of the sealing device, namely the drinking spout (50), the retaining ring (4) and the two ferrules A and B are made as a single piece. Once the bottle has been filled with the liquid, this sealing device becomes an integral part of the container (19), except for the cap (2) designed to protect the drinking spout (50).

The built-in rotary closure allows mothers to seal the child's feeding bottle or bottle of mineral water securely, with the possibility of keeping the remaining liquid for later use. Said feeding bottle or said bottle is intended for drinks for infants aged 0 to 2.

The invention claimed is:

1. A device for sealing a feeding bottle or bottle, characterized in that it comprises:

a teat a retaining ring an internal screw thread intended to collaborate with the screw thread of the feeding bottle or bottle, characterized in that it comprises a repositionable rotary safety closure inserted between the retaining ring and the screw thread of the feeding bottle or bottle, this closure being able to be moved between a position in which it completely closes the feeding bottle or bottle and a position that allows a liquid contained in the feeding bottle or bottle to flow, the repositionable rotary closure comprising two superposed ferrules, with their top surfaces in the form of flat disks, each having an opening and configured as follows:

an external ferrule bearing a screw thread intended to accept the retaining ring and a first disk having an off-centered opening partially closing off the feeding bottle or the bottle, the surface area occupied by the opening being more than ¼, an internal ferrule bearing an internal screw thread and a second disk having an off-centered opening partially closing off the feeding bottle or bottle and in contact with the first disk, it being possible for the external ferrule to be orientated in such a way that the openings and of the first and second disks respectively face one another to allow a liquid contained in the feeding bottle or bottle to flow and in such a way that the openings and of the first and second disks respectively are offset, completely closing off the feeding bottle.

2. The feeding bottle or bottle sealing device as claimed in claim 1, characterized in that the external ferrule has external ribs so that it can be turned with a view to fully sealing or opening the feeding bottle or the bottle.

3. The feeding bottle or bottle sealing device as claimed in claim 1, characterized in that the external ferrule has an outside diameter greater than that of the other elements of the device, the internal ferrule being set within the external ferrule.

4. The feeding bottle or bottle sealing device as claimed in claim 1, characterized in that each of the off-centered openings and occupies more than ¼ of the surface area of the disk, allowing the liquid to flow.

5. The feeding bottle or bottle sealing device as claimed in claim 1, characterized in that the external ferrule may, on the inside, have a pivot joining the two ferrules and together, and a sealing gasket to enhance the seal.

* * * * *